United States Patent [19]

Klopfleisch et al.

[11] Patent Number: 5,022,496

[45] Date of Patent: Jun. 11, 1991

[54] SLOWDOWN DURING STAGING OF A TURRET STOCKPICKER

[75] Inventors: Kim A. Klopfleisch, St. Marys; Tim A. Wellman, Coldwater, both of Ohio

[73] Assignee: Crown Equipment Corporation, New Bremen, Ohio

[21] Appl. No.: 446,224

[22] Filed: Dec. 5, 1989

[51] Int. Cl.[5] ..... B66B 9/20

[52] U.S. Cl. ..... 187/9 E; 187/95; 187/111

[58] Field of Search ..... 182/141; 187/9 E, 95, 187/102, 110, 111, 29.2

[56] References Cited

U.S. PATENT DOCUMENTS

| | | | |
|---|---|---|---|
| 2,790,513 | 4/1957 | Draxler | 187/9 R |
| 3,107,750 | 10/1963 | Bishop | 187/9 E |
| 3,542,161 | 11/1970 | Ulinski | 187/9 E |
| 4,280,205 | 7/1981 | Dammeyer | 187/9 E X |

*Primary Examiner*—Robert P. Olszewski
*Assistant Examiner*—Dean A. Reichard
*Attorney, Agent, or Firm*—Biebel & French

[57] ABSTRACT

A materials handling vehicle, such as a turret stockpicker, includes a telescoping mast comprising inner and outer sections. The staging of these sections, and the stopping of the platform assembly is smoothed by monitoring the actual height of the platform and restricting the speed of the platform as it approaches these transition points. The height of these transition points are stored in a digital memory. The platofrm speed is normally determined by a control handle, but as the platform reaches a transition point, the maximum speed of the platform is restricted by a micro-computer which controls a servo controlled hydraulic valve and the hydraulic pump motor supplying hydraulic fluid to the platform lifting cylinders. The maximum rate of platform movement after a transition is returned to the control of the operator.

6 Claims, 9 Drawing Sheets

SLOWDOWN DURING STAGING OF A TURRET STOCKPICKER

BACKGROUND OF THE INVENTION

This invention relates to a system for controlling the rate of extension of a two stage telescoping mast of a materials handling vehicle.

In a materials handling vehicle, such as a turret stockpicker, an operator's platform mounted on a telescoping mast may be raised, along with a load handling assembly supporting load carrying forks, from floor level to the maximum height of the mast. The platform is raised until it reaches the top of the outer section of the mast. At this time, staging occurs, that is, as the platform is raised further, the platform picks up the outer section of the mast which telescopes on the inner or main section until the assembly reaches its maximum height, in the order of 35 feet.

When staging occurs, the weight of the structure being moved upwards is increased by the weight of the outer section of the mast, and in prior art vehicles, this sudden increase in weight causes a momentary deceleration that is severe enough to be uncomfortable to the operator. This is true even though shock absorbers are used between the platform and the outer mast section. Also, when the platform reaches its upper or lower limits, if this speed is not reduced, a sudden de-acceleration will result.

SUMMARY OF THE INVENTION

In the present invention, the speed of the platform lifting motion is decreased immediately prior to and during staging, and prior to stopping thus providing for smooth platform movement.

In a preferred embodiment of this invention, a hydraulic cylinder or ram provides the lifting power to raise the platform. The flow of hydraulic fluid to the cylinder will be restricted momentarily during staging and prior to reaching predetermined stops in response to the height of the operator's platform.

It is therefore an object of this invention to provide an improved method and apparatus for controlling the movement of a platform during any transition, such as staging or when the platform reaches a stop, by sensing the actual height of the platform and by metering the flow of hydraulic fluid through the control valve, and also by limiting the speed of the hydraulic pump, a predetermined distance prior to the transition.

It is a further object of this invention to provide a materials handling vehicle including a power unit, a telescoping mast comprising inner and outer sections, a platform assembly, and means for raising and lowering the platform, means for sensing the position of the platform with respect to the mast, means responsive to said sensing means for slowing the rate of movement of the platform immediately before and during staging, and means for resuming rate of platform movement after staging.

It is a still further object of this invention to provide a method of staging the sections of a telescoping mast in a turret stockpicker comprising the steps of moving the platform, monitoring the height of the platform, slowing the platform immediately prior to and during the staging of the mast sections, and thereafter continuing to move raise the platform at the original speed after staging has occurred.

Other objects and advantages of the invention will be apparent from the following description, the accompanying drawings and the appended claims.

DESCRIPTION OF THE PREFERRED EMBODIMENT

Figure 1:
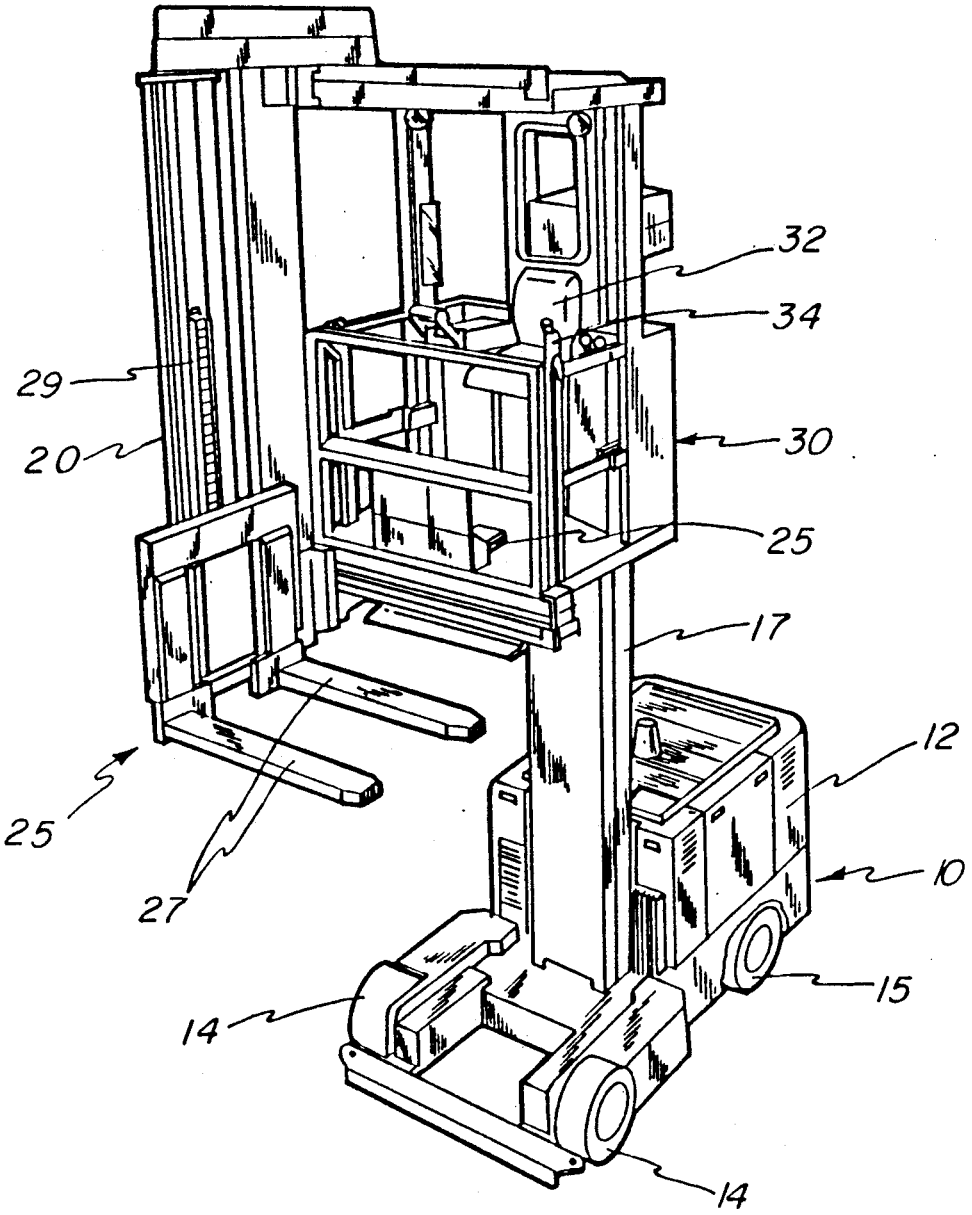
FIG. 1 is a perspective view of a materials handling vehicle, and particularly a turret stockpicker utilizing a system for slowing the rate of movement of the operator's platform during staging or stopping.
Figure 2:
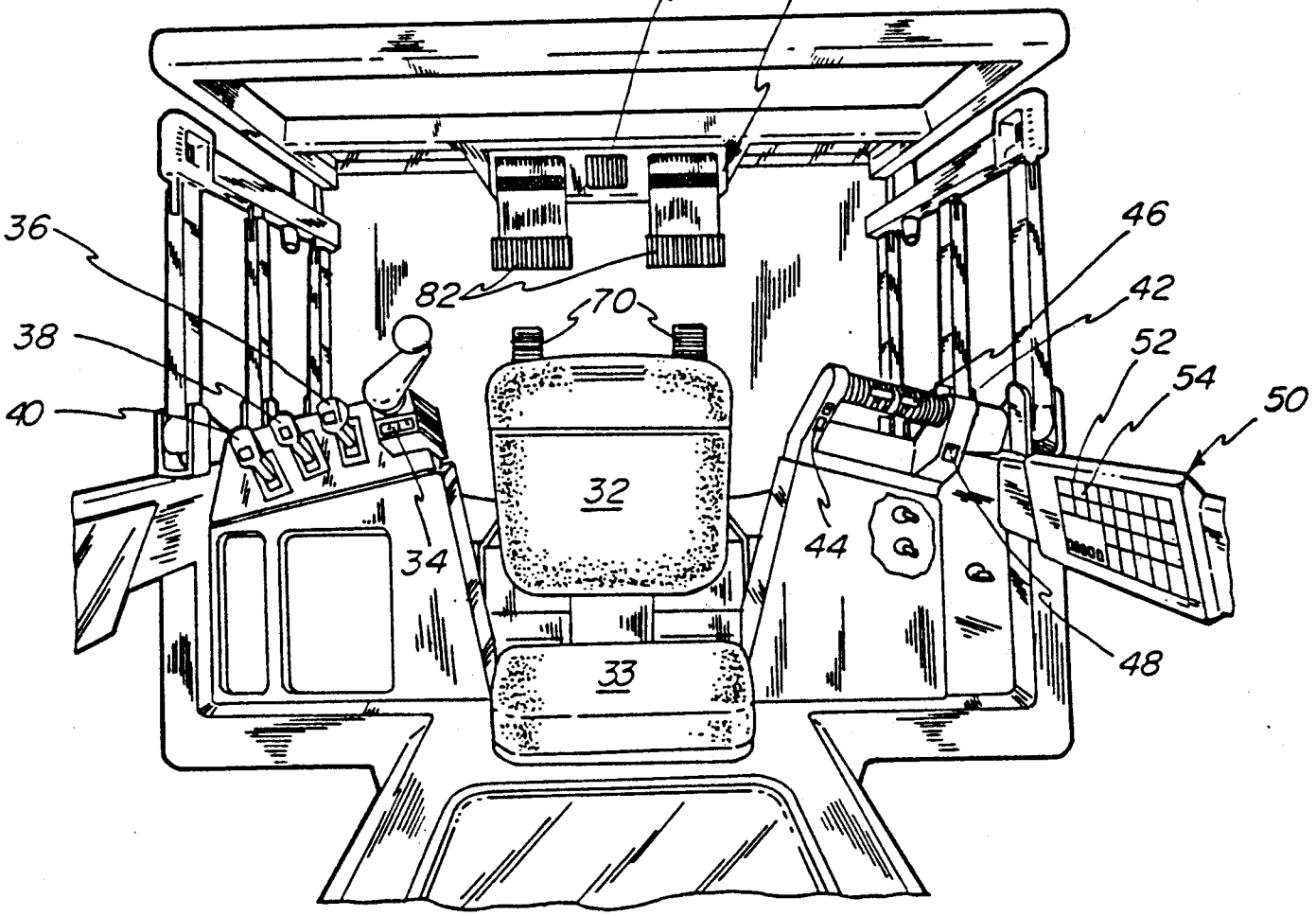
FIG. 2 is a plan view of the operator's platform and various vehicle controls.

Referring now to the drawings, and particularly to FIG. 1 which illustrates a materials handling vehicle, such as a turret stockpicker, the vehicle includes a power unit 10, a load handling assembly 20, and a platform assembly 30.

The power unit 10 includes a power source, such as a battery unit 12, a pair of load wheels 14 positioned under the platform assembly, a pair of steered wheels 15 positioned under the rear end of the power unit 10 with each wheel being driven by a traction motor, a mast 17 on which the platform assembly 30 rides, and a power unit electronic control unit.

The load handling assembly 20 includes a fork carriage assembly 25 which may be raised and lowered and also rotated relative to the load handling assembly. A pair of extendable forks 27 are carried by the fork carriage assembly. The fork carriage assembly may be raised from the position shown by means of an auxiliary lift cylinder 29 to place the forks at a convenient height for the operator to place individual packages on the forks, when the vehicle is being used in this mode, or to move the forks upwardly, without moving the platform assembly itself, when lifting pallets of boxes from a rack adjacent the aisle where the vehicle is operating.

The platform assembly 30 includes a seat 32, and back rest 33, from which the operator can operate various controls. A seat switch indicates whether the operator is seated or standing. On the operator's left, the controls include a steering tiller 34, a raise and lower control 36, a fork traverse, retract and extend control 38, and a pivot control 40. On the right, the operator is provided with a traction motor control 42, which includes a horn switch 44, an accelerator twist grip and palm switch 46, and a power disconnect switch 48. An indicator control panel 50 to the right of the operator includes various indicator lamps and control switches, such as parking brake switch 54. The platform includes an electronics package that is interconnected with the power unit electronics package by means of a serial link through an appropriate cable.

Figure 3:
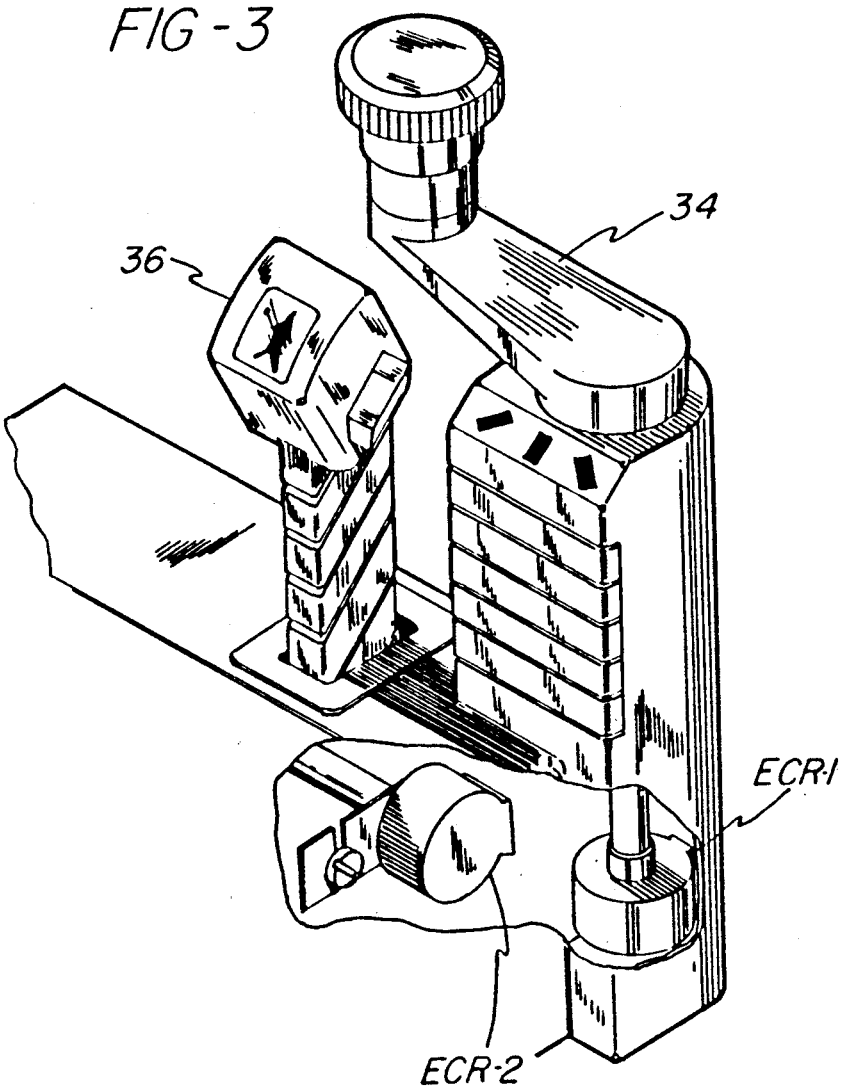
FIG. 3 is a perspective view of a raise/lower control handle and associated position encoder.

The control handle 36 (FIG. 3) is connected to and rotates an encoder ECR-2 which is connected to the platform electronics package.

Figure 4:
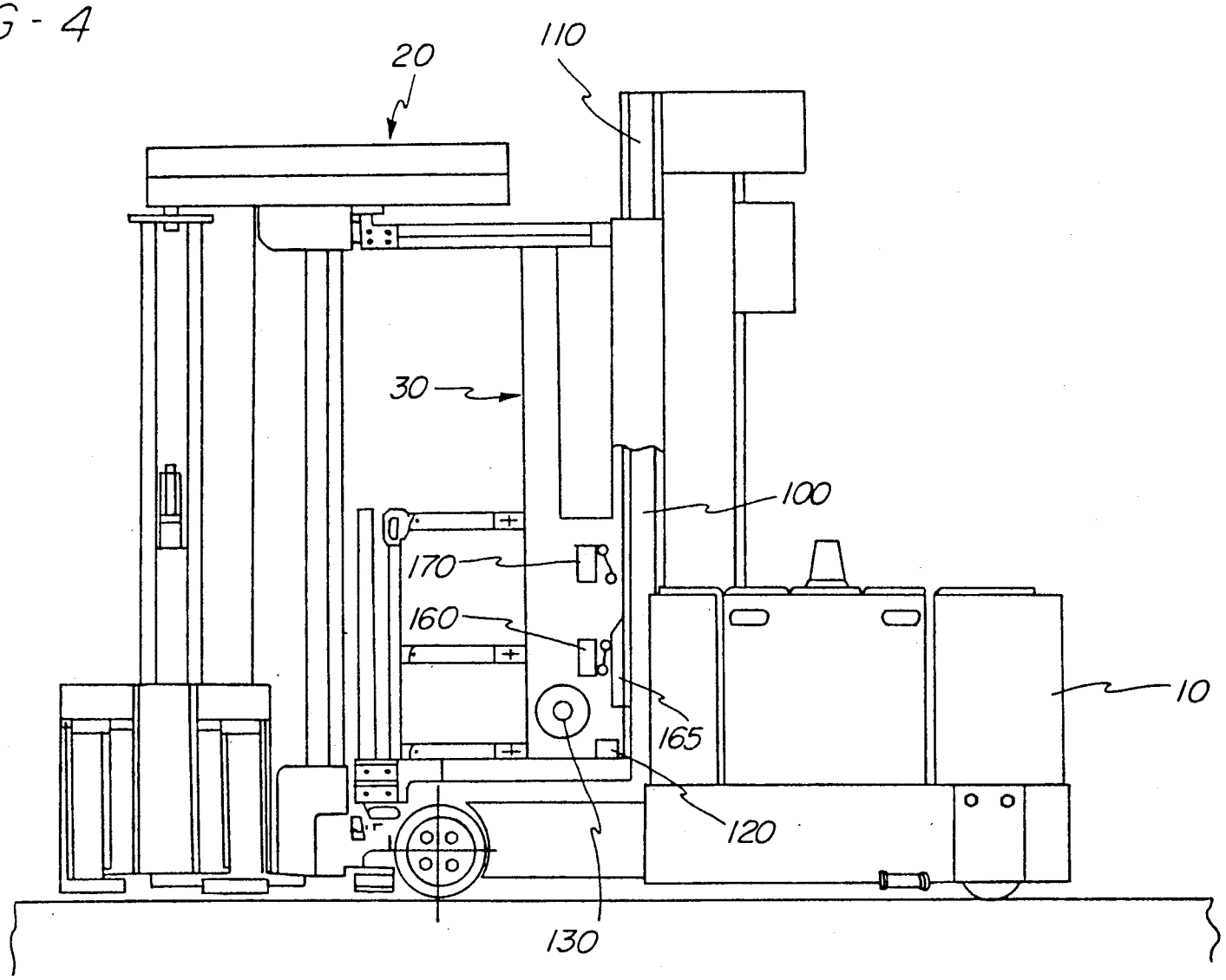
FIG. 4 is a side elevational view of a turret stockpicker showing the platform assembly in its lower or rest position.
Figure 5:
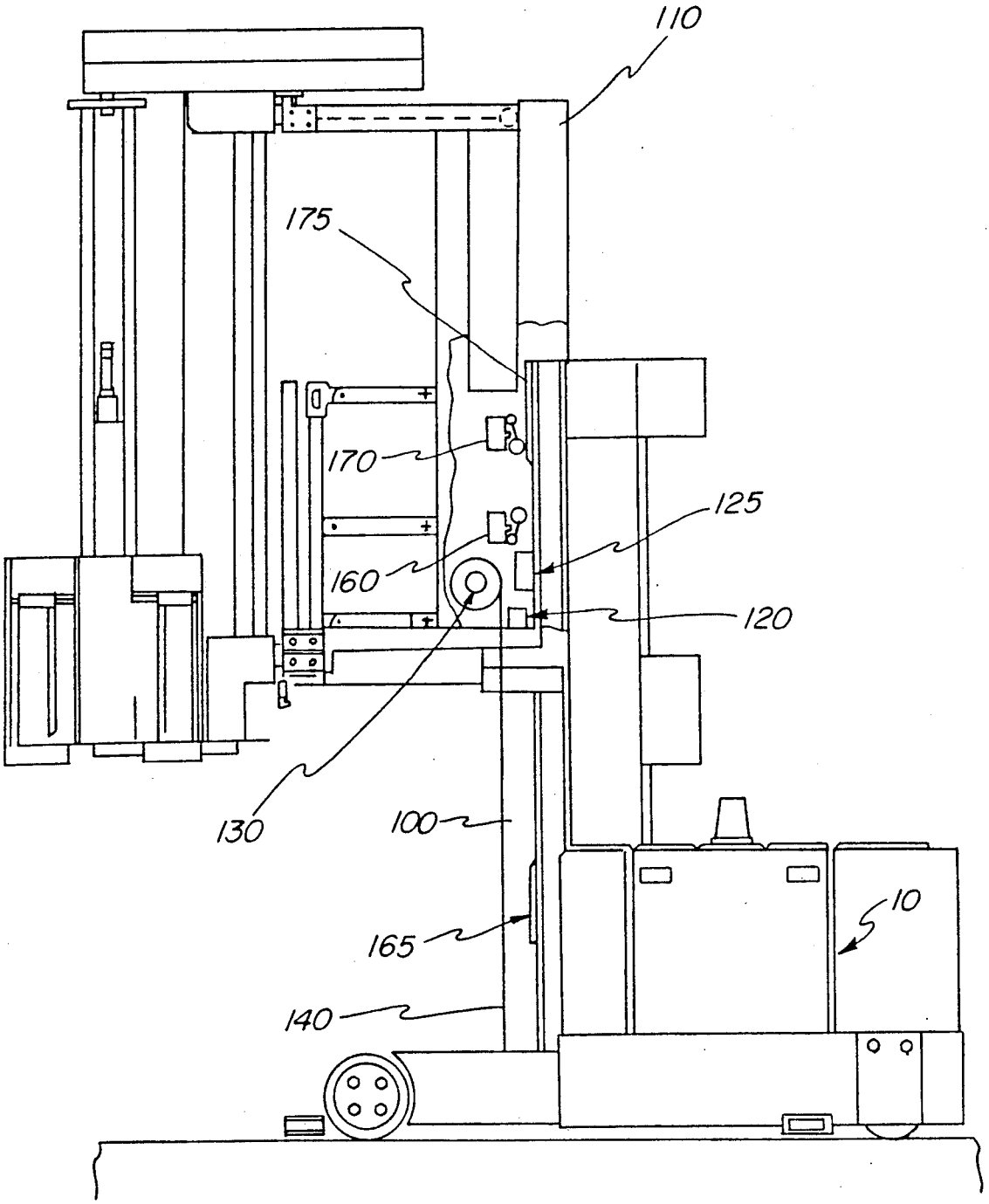
FIG. 5 is a side elevational view of a turret stockpicker showing the platform assembly as it approaches staging.
Figure 6:
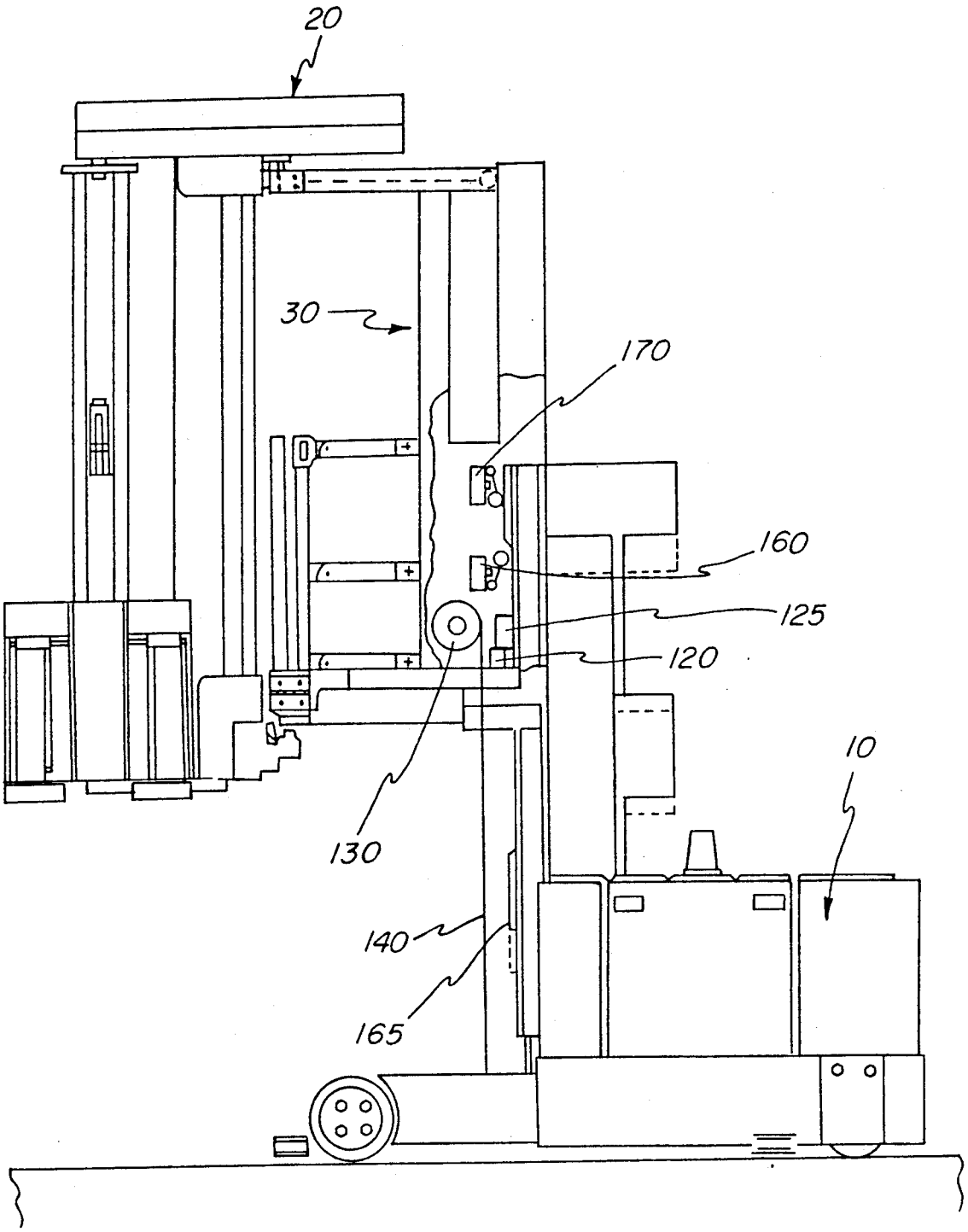
FIG. 6 is a side elevational view of a turret stockpicker showing the platform assembly after staging has occurred.

Referring now to FIGS. 4–6, the mast 17 includes two sections, a main mast section 100 that is firmly attached to the power unit 10, and a second stage or outer mast section 110 that surrounds and is in telescoping relation with the main mast section. Hydraulic cylinders are provided to raise the platform assembly on rails formed in the outer mast. Power to the hydraulic cylinders is provided by a motor and pump, and flow is controlled by a servo controlled valve, under control of the raise/lower handle 36. When the platform assembly reaches the top of the outer mast, stops 120 on the platform assembly engage stops 125 on the exterior of the outer mast, causing both the platform assembly and the outer mast to slide upwardly on the main or inner mast section. Details of the construction of the mast and the hydraulic cylinders and associated cables and pulleys may be found in U.S. Pat. No. 4,552,250 assigned to the same assignee as the present invention.

A height encoder 130 is mounted on the platform assembly 30. The height encoder 130 is a conventional optical encoder that is attached to a reel on which is wound a cable 140, with the end of the cable being attached to the power unit 10. Thus, as the platform assembly 30 moves vertically with respect to the power unit 10, the encoder 130 will rotate and sense this movement and provide an output to a microcomputer 200, shown in FIG. 7.

The platform assembly 30 is provided with a pair of stops or bumpers 120, one of which is shown in FIGS. 4–6. The outer section 110 of mast 17 includes stops 125 in vertical alignment with the stops 120 on the platform.

A reset switch 160 is laterally displaced from the stop 120 on the platform and, as shown in FIG. 4, this switch is actuated by a first rail or cam 165. The reset switch 160 will be actuated whenever the platform is within 18 inches of it lowermost or rest position, as shown in FIG. 4. For each transition of the reset switch 160, either on or off, the height RAM 166 will be reset to 18 inches. Thereafter, the height RAM will store the present value of the platform assembly height. This is more fully described in copending application Ser. No. 07/446,223 filed Dec. 5, 1989.

A calibration or verification switch 170 is also carried by the platform, and it is actuated by a second rail or cam 175 mounted on an upper portion of the outer mast section 110 (FIG. 5). The verification switch 170 is actuated by the cam 175 when the platform is within approximately 6 inches of actual staging, that is, when the stops 120 on the platform assembly 30 are about to engage the stops 125 on the outer mast section. This switch is used by the height measurement circuitry to verify that the height sensing encoder 130 is operating properly.

Figure 7:
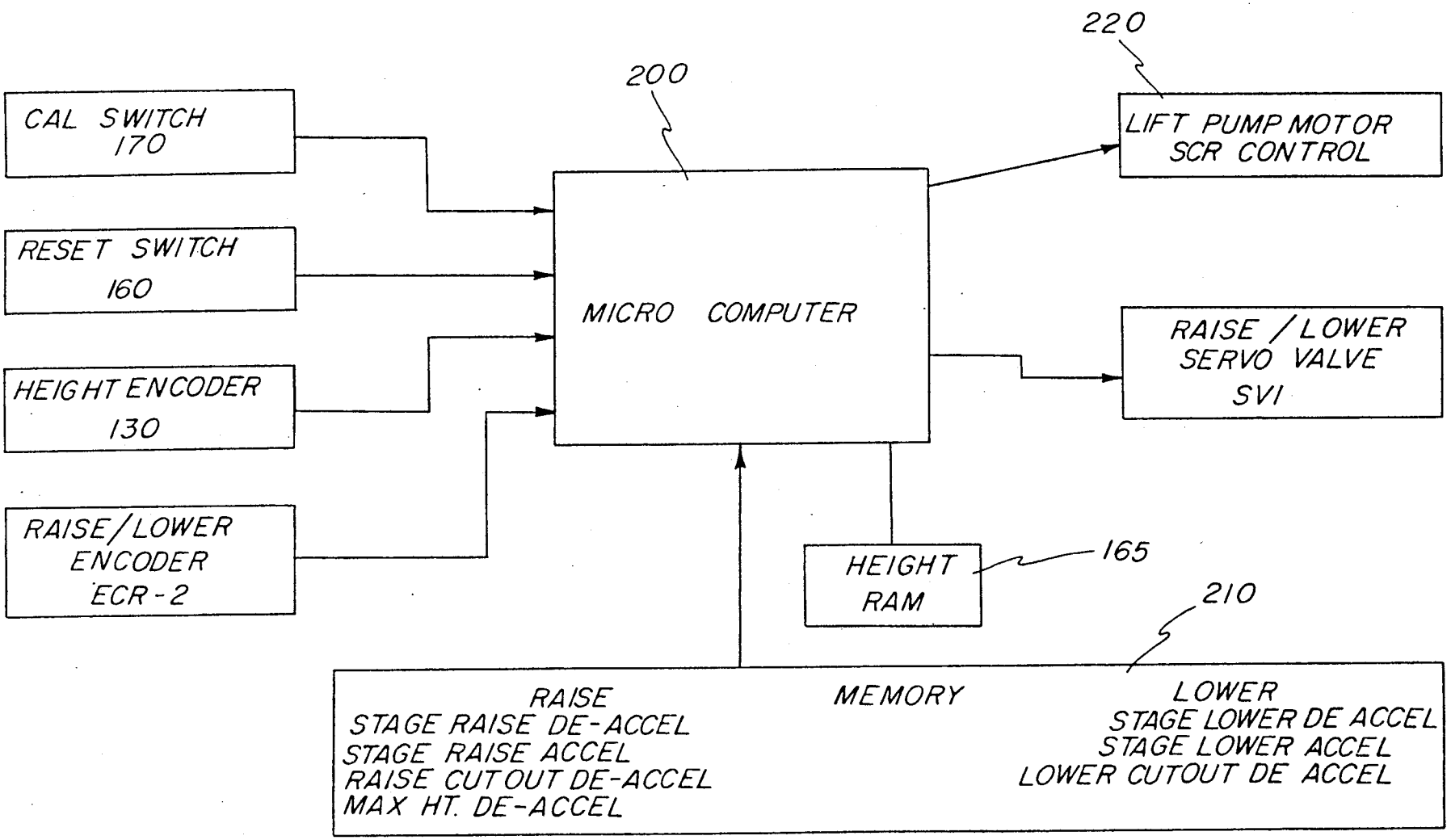
FIG. 7 is a simplified electrical block diagram showing the various components comprising the present invention.

FIG. 7 is a simplified electrical block diagram showing the various components comprising the present invention. As shown, a micro-computer 200 receives platform height information from the height encoder 130 and compares this data with predetermined heights stored in memory 210. As the platform reaches each of these distances, the micro-computer 200 adjusts the control signal to both the SCR pump motor control 220 and the servo controlled valve SV1. The micro-computer 200 also received inputs from the raise/lower encoder ECR-2 associated with the control handle 36. The reset switch 160 and the calibration switch 170 also provide input to insure the height readings from the encoder 130 are accurate and reliable, as more fully described in copending application Ser. No. 07/446,223 filed Dec. 5, 1989.

Figure 8:
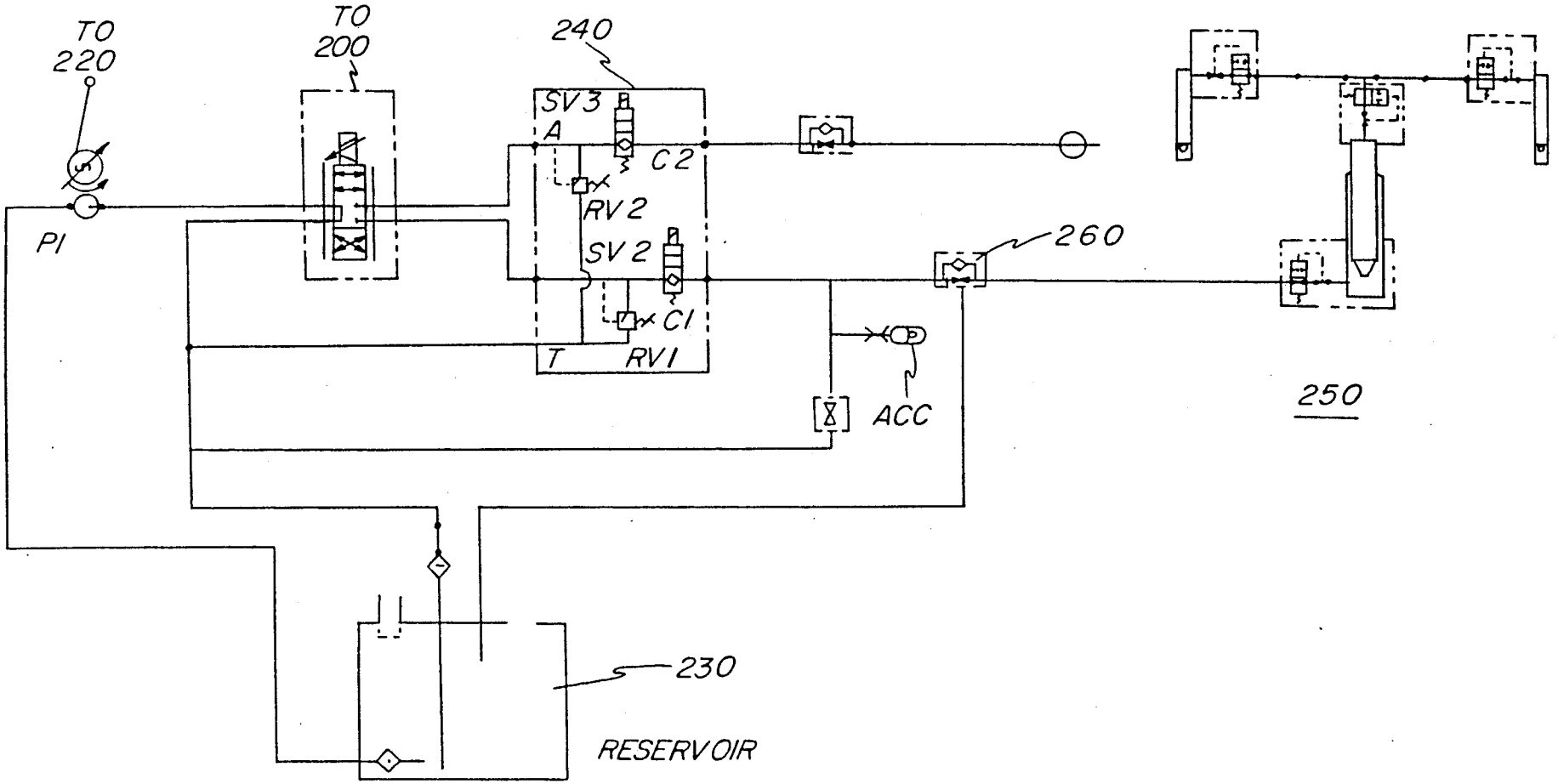
FIG. 8 is hydraulic schematic diagram of the platform raise/lower components.

Referring now to FIG. 8, the hydraulic pump P1 and its motor M1 receives power from the SCR control 220, and the servo valve SV1 is positioned by the micro-computer 200 in response to the position of the control handle, as described in copending application Ser. No. 07/446,274 filed Dec. 5, 1989, now U.S. Pat. No. 4,943,756. The pump P1 supplies hydraulic fluid from a reservoir 230 through the valve SV1 to a manifold 240 where it is distributed to the main platform lift cylinders, shown generally at 250, and to auxiliary lift cylinders, not shown. Solenoid valves SV2 and SV3 are also controlled by the micro-computer 200 and serve to block the return flow of hydraulic fluid through the valve SV1 when the control handle is in it neutral position and the platform is stationary. Pressure to the lift cylinders 250 is maintained by an accumulator ACC, while return flow from the cylinders to the reservoir 230 is limited by a flow control device 260.

Figure 9:
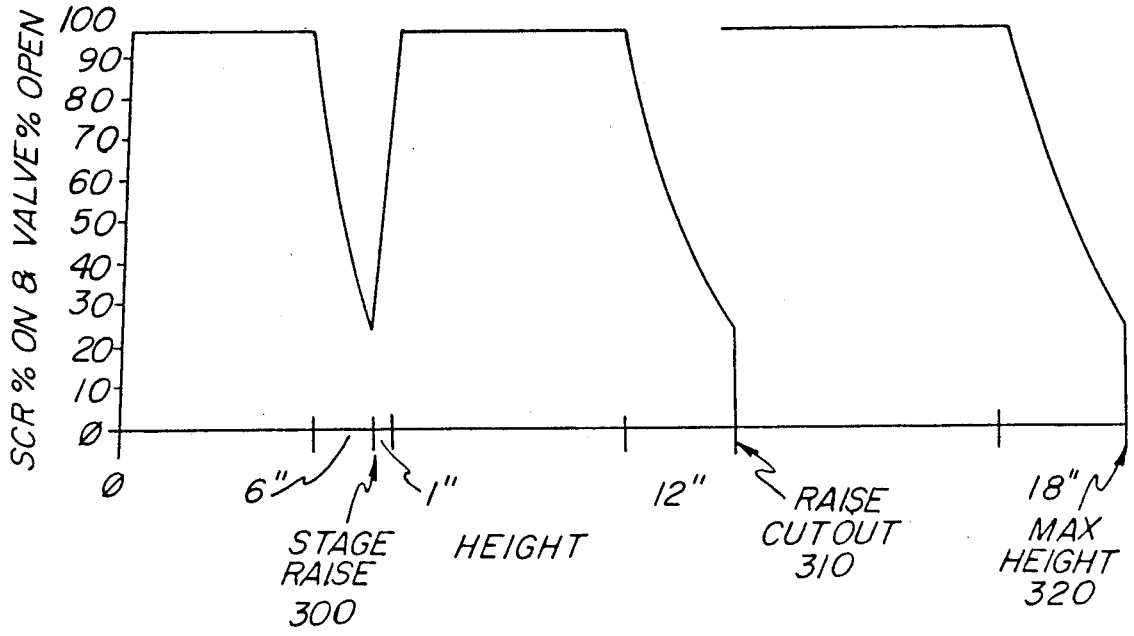
FIG. 9 is a chart showing the maximum power to the pump motor and the control valve opening permitted in relation to the platform as it is raised from its rest position to its maximum height.

The process of raising the platform assembly is illustrated in the chart of FIG. 9 where the control of SCR motor control circuit 220 and the servo controlled valve SV1 are both shown. Assuming the operator has moved the control handle 36 to the fully up position, maximum power for lifting is initially provided. Following the diagram from left to right, as the platform approaches within a predetermined distance of staging at 300, 6 inches as illustrated, power to both the pump motor and the valve are reduced from full power (approximately 99%) to 24% at staging, along the curve shown. After staging, full power is restored to the lifting components during the next 1 inch of travel.

As the platform continues to rise, it eventually reaches either a raise cutout position 310 (a programmed height selected by the user which is lower than maximum height) or its maximum height position 320. As shown, when the platform is within 12 inches of the raise cutout position, or 18 inches of its maximum height, power to the pump and valve is again cut back from full to 24% of full value. Thus, as the platform stages, or as it approaches a stop, the rate of upward movement of the platform is restricted by a program stored in the micro-computer according to the curve shown, thereby smoothing the transition from full speed through staging or to a full stop.

Figure 10:
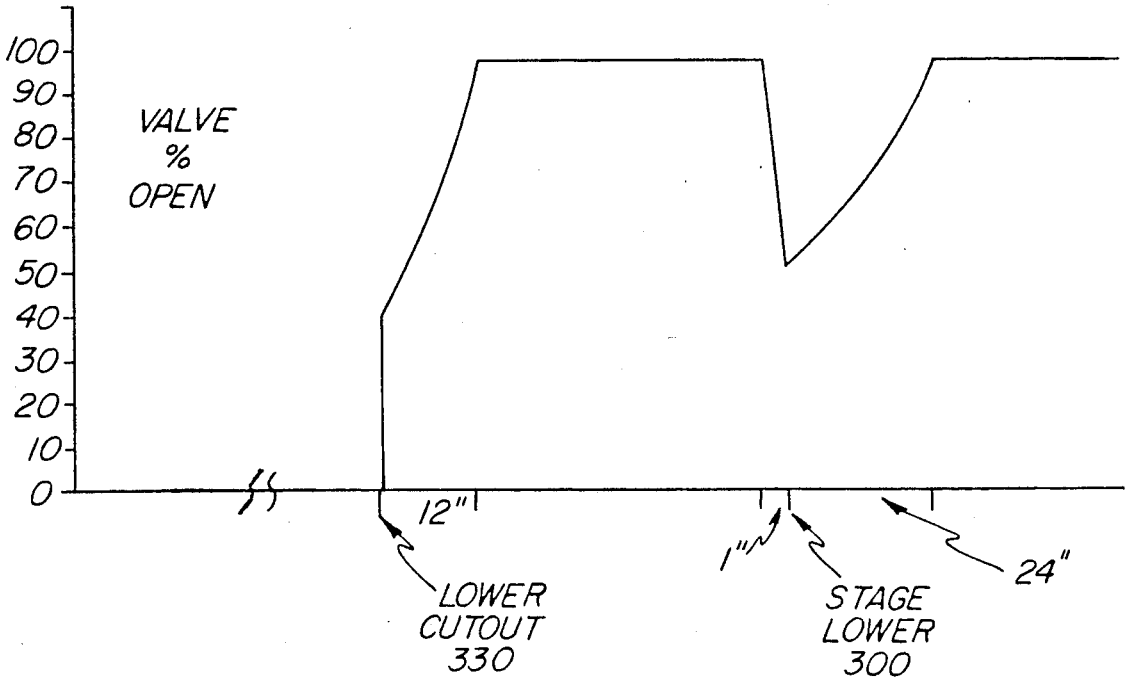
FIG. 10 is a chart showing the maximum valve opening permitted at various platform locations as the platform is lowered.

The process of lowering the platform assembly is shown in the chart of FIG. 10, which is read from right to left. As the platform is being lowered, the valve SV1 is permitted to be initially 99% open and maximum lower speed is permitted. Approximately 24 inches from staging at 300, the valve opening will be restricted according to the curve shown until it is only approximately 52% open. After staging, the valve will be permitted to open fully during the next 1 inch of travel. When the platform assembly approaches within 12 inches of either a lower cutout 330 or its lowest position, the valve opening is reduced from its maximum to approximately 40% of maximum. The distance prior to a transition, the amount of speed reduction, and the speed reduction curve, are determined empirically, and will vary according to the vehicle on which this invention is used, the type of transition involved, and the direction of platform movement.

If the control handle is not in its fully open or on position during either raising or lowering, the response curve shown will be picked up at the handle position. For example, if the handle is at 70% open, as shown in FIG. 9, then the slowdown will begin at less than 6 inches from staging. If the control handle is demanding less than the slowdown curve, for example, less than 24% open, then the control handle command will be followed.

Restricting the valve opening on lowering and both the valve opening and the pump motor speed on raising, during either staging or stopping, smoothes the transition during these events, reduces wear on the equipment, and provides for operator comfort.

While the method herein described, and the form of apparatus for carrying this method into effect, constitute preferred embodiments of this invention, it is to be understood that the invention is not limited to this precise method and form of apparatus, and that changes may be made in either without departing from the scope of the invention, which is defined in the appended claim.

I claim:

1. In a materials handling vehicle including a power unit, a telescoping mast comprising inner and outer sections, a platform assembly, and means for raising and lowering the platform, the improvement comprising means for sensing the position of the platform with respect to the mast, means responsive to said sensing means for slowing the rate of movement of the platform immediately before and during staging, and means for resuming rate of platform movement after staging.

2. The vehicle of claim 1 wherein said sensing means includes a digital encoder, means for converting the output of said digital encoder to a distance measure, and means for recording the platform heights for platform slow down.

3. The vehicle of claim 1 wherein said platform is slowed a first predetermined distance before and a second predetermined distance after staging.

4. The vehicle of claim 1 wherein said platform is raised and lowered by hydraulic means and wherein said means for slowing the rate of platform movement includes means for restricting the flow of hydraulic fluid.

5. In a materials handling vehicle including a power unit, a telescoping mast comprising inner and outer sections, a platform assembly, and means for raising and lowering the platform, the improvement comprising means for sensing the position of the platform with respect to the mast, and means responsive to said sensing means for slowing the rate of movement of the platform immediately before and during any staging and immediately before reaching the upper or lower limit of travel, and means for resuming the rate of platform movement after staging.

6. A method of staging the sections of a telescoping mast in a turret stockpicker comprising the steps of moving a platform, monitoring the height of the platform, slowing the platform immediately prior to and during any staging of mast sections, and resuming the rate of platform movement after staging.

* * * * *